United States Patent [19]

Oguchi et al.

[11] 4,000,960

[45] Jan. 4, 1977

[54] APPARATUS FOR MANUFACTURING SYNTHETIC TOW FOR STRETCH-CUT SPINNING PROCESS

[75] Inventors: Noboru Oguchi; Takashi Hiramatsu; Ikuo Igami, all of Nagoya; Akira Aoki, Inazawa; Syogo Tanaka, Otake; Toshiro Seki, Otake; Takao Inoue, Otake, all of Japan

[73] Assignee: Mitsubishi Rayon Company, Ltd., Tokyo, Japan

[22] Filed: Oct. 29, 1974

[21] Appl. No.: 518,974

Related U.S. Application Data

[62] Division of Ser. No. 277,990, Aug. 4, 1972, abandoned.

[52] U.S. Cl. ..... 425/76; 264/167; 425/67

[51] Int. Cl.[2] ..... D01D 5/20

[58] Field of Search ..... 425/66, 67, 68, 76; 264/168, 178 F; 167, 28/71.3

[56] References Cited

UNITED STATES PATENTS

| | | | |
|---|---|---|---|
| 3,242,248 | 3/1966 | Terra | 28/71.3 UX |
| 3,332,226 | 7/1967 | Rosenstein | 425/76 X |
| 3,444,682 | 5/1969 | Polacco et al. | 264/167 X |

FOREIGN PATENTS OR APPLICATIONS

| | | | |
|---|---|---|---|
| 730,356 | 8/1932 | France | 425/68 |
| 567,944 | 1/1933 | Germany | 425/66 |
| 367,223 | 2/1932 | United Kingdom | 425/66 |

*Primary Examiner*—Robert D. Baldwin
*Attorney, Agent, or Firm*—Armstrong, Nikaido & Wegner

[57] ABSTRACT

Apparatus for manufacturing synthetic tow for stretch-cut spinning process. The synthetic tow is produced by changing the coagulation condition after delivery from the spinnerets so the weak points are distributed in individual filaments in a particular condition defined by variation of uneveness of breaking strength. The coagulation condition of each filaments in the two is positively changed according to periodic changes in the filament's passage by contacting a deviation bar disposed in the filament's passage.

6 Claims, 8 Drawing Figures

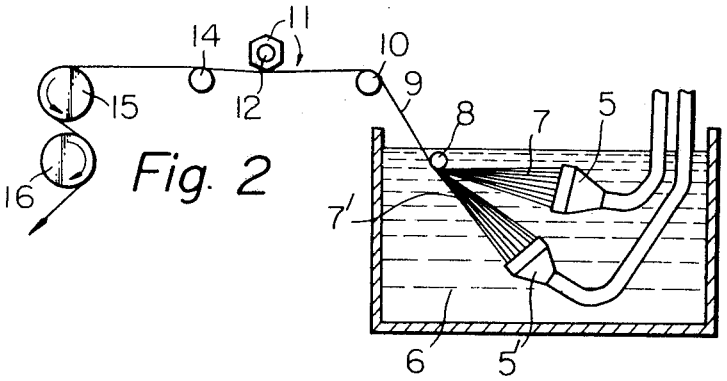
Fig. 2
Fig. 3A
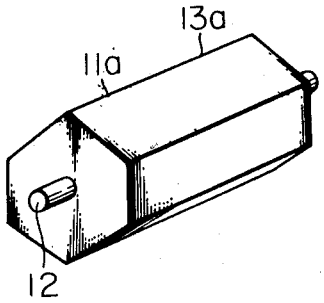
Fig. 3B
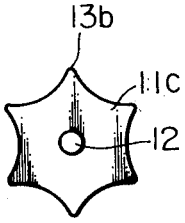
Fig. 4
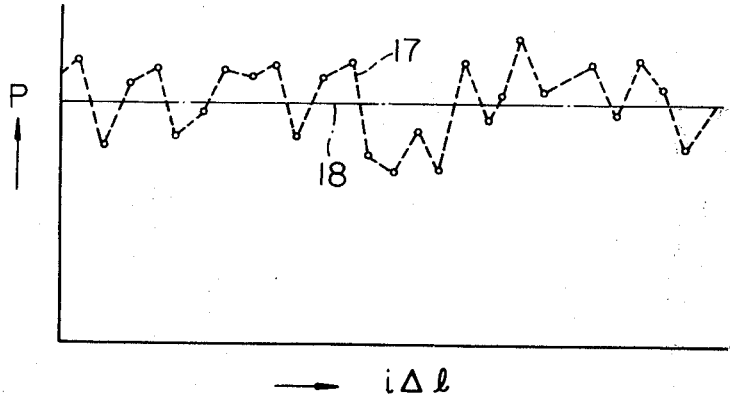

APPARATUS FOR MANUFACTURING SYNTHETIC TOW FOR STRETCH-CUT SPINNING PROCESS

BRIEF SUMMARY OF THE INVENTION

The present invention is a divisional patent application of the pending patent application Ser. No. 277,990 filed on Aug. 4, 1972, now abandoned, and relates to an apparatus for producing a synthetic tow having inherent physical properties being suitable for carrying out so-called stretch-break operations to produce a sliver, and a method for manufacturing thereof.

Because of the high productivity of the machines and the high quality of the product several practical stretch-break machines, have been preferably applied for producing a sliver directly from a synthetic tow. The Perlock Converter is a machine of this type known throughout the world. Machines of this type produced by the O-M limited in Japan (Trade name "OM Tow reactor") and by Seydel & Co. in Germany (Trade name "Seydel Converter") are well known, even though only recently developed for practical use.

In the process of the stretch-break method for producing slivers directly from the synthetic tow, it is necessary to supply a synthetic tow having physical properties suitable for the practice of the stretch-break operation. According to our experience, problems arise if the individual filaments in the synthetic tow are stretch broken at a very restricted longitudinal area of the stretch-break zone, that is the individual filaments are stretch broken as a bundle. The problems involve: a remarkable increase in the load applied to the machine for carrying out the stretch-break operation; an increase in the tendency of wrapping fibers about a roller, and; further, it is inevitable excessive short fibers are produced. These latter create yarn breaks during the spinning operation, or form yarn of abnormal thickness such as the yarn defects called slub yarn or neppy yarn. Consequently, it has been strongly requested that the above-mentioned type of draft cut phenomena be eliminated.

To solve the above-mentioned problem, we have conducted research to analyze the stretch-break phenomena. According to our fundamental research, it was found that the mutual interference between fibers affects the distribution of the stretch-break positions of the individual filaments. This mutual interference is mainly influenced by the quality of the oil applied for producing the synthetic tow and by the parallelism of the individual filaments of the tow. Moreover, we found the very interesting fact that the variation of the breaking strength of individual filaments, taken along the longitudinal axis of the tow, remarkably affects the distribution of the stretch-break positions of the individual filaments. Based on the above-mentioned findings of our research work, the principle of the present invention was introduced.

According to the present invention, the pertinent synthetic tow must satisfy the following conditions of physical properties: (a) the static coefficient of friction between fibers is in a range between 0.20 and 0.35; (b) the dynamic coefficient of friction between fibers is in a range between 0.18 and 0.30; (c) the average ratio of lengthwise variation in connection with the breaking strength is in a range between 8 and 20%; (d) unevenness of breaking strength of individual filaments along the transversal direction of the synthetic tow is below 10%; (e) unevenness of breaking strength of individual filaments along the longitudinal direction of the synthetic tow below 9%.

In order to produce the synthetic tow, having the above-mentioned characteristic features, in the apparatus of the present invention, the bundle of filaments are drawn in such a way that they are subjected to contact a bar device which is rotatable about an axis transversally disposed to the passage of the bundle of filaments. This contact is at a particular position which is before or just after completion of the coagulation of the individual filaments in the bundle, which is spun from a spinneret of the spinning machine. This bar device comprises a plurality of blades which are radially extended from the axis. A bar device having a polygonal cross section, wherein the axis passes through the center of the polygonal cross section, can be satisfactorily applied instead of the above-mentioned bar device. It is important to select the position of the axis of the above-mentioned bar device. Further, when the apparatus of the present invention is operated, the bundle of the filaments is periodically biased in its passage from its normal position so that excessive tension is applied to each individual filaments. This period must be carefully chosen in a relative condition with the spinning speed (V). In connection with the above-mentioned periodical deviation of the bundle passage, a suitable magnitude of deviation is required.

The principal object of the present invention is to provide an apparatus for producing a synthetic tow having particular physical properties by which the above-mentioned drawbacks can be eliminated.

Other objects, advantages and characteristic features of the present invention are hereinafter illustrated in conjunction with the claims and the accompanying drawings.

BRIEF EXPLANATION OF THE DRAWINGS

FIG. 2 is a schematic side view, partly in longitudinal cross-section, of the apparatus according to the present invention, FIG. 3A is a perspective view of an embodiment of a deviation device applied to the apparatus shown in FIG. 2, FIG. 3B is a side view of a modified embodiment similar to the device shown in FIG. 3A, FIG. 4 is an explanatory diagram showing the lengthwise variation of the breaking strength of an individual filament.

DETAILED EXPLANATION OF THE INVENTION

Before entering into the detailed illustration of the present invention, the background and the principle of the present invention will first be explained.

Figure 1A:
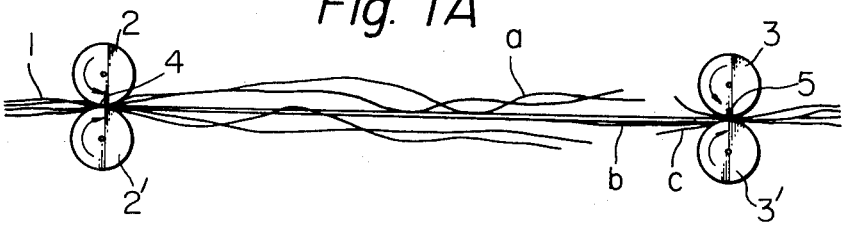
FIGS. 1A, 1B, 1C and 1D are diagrams for explaining the stretch-break operation applied for a synthetic tow.

Referring to FIG. 1A, which shows a schematic diagram of the principle element for stretch-break operation, the principle element consists of a pair of feed-rollers 2, 2', and a pair of delivery rollers 3, 3' rotating at a higher surface speed than that of the feed rollers 2, 2'. A tow 1, which consists of a plurality of endless filaments, is fed into the nip of the feed rollers 2, 2'. These endless filaments are subjected to the stretch-break operation in the zone between the rollers 2, 2' and 3, 3'. The endless filaments are stationary stretch broken in the stretch break zone as shown in FIG. 1A. When the stationary stretch break operation is carried out: draft cut fibers **1*a* are still gripped by the rollers 2,**

2'; endless filaments 1*b* are subjected to extension according to the surface speed difference between the feed rollers 2, 2' and the delivery rollers 3, 3', and; stretch broken fibers 1*c* have left the rollers 2, 2' and are gripped by the rollers 3, 3'.

Therefore, when we analyze the stretch break operation, the above-mentioned three different types of fibers should be considered.

Figure 1B:
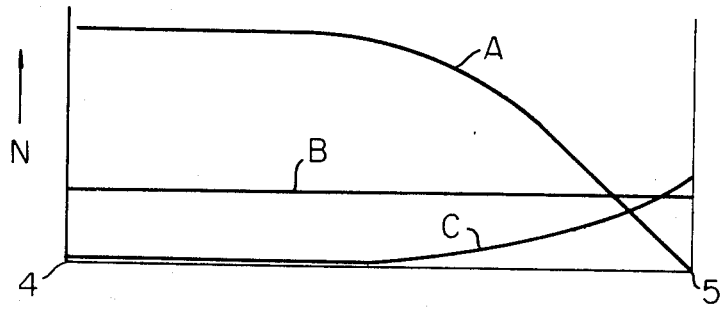
Figure 1C:
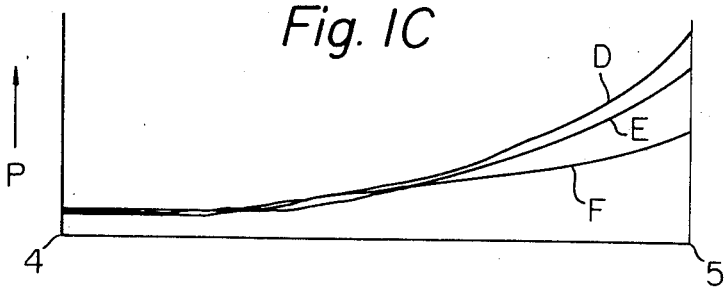

During our experimental test, a very interesting phenomena was observed. In order to observe the above-mentioned three types of fibers the stretch-break mechanism was stopped and the number (N) of fibers A, filaments B and fibers C were counted. The diagrams A, B and C shown in FIG. 1B represent how the endless filaments are draft cut. In these diagrams, the ordinate represents number (N) of fibers or filaments, which belong to anyone of the above-mentioned three different types, when observed at positions along the passage of fibers in the stretch break zone. As shown in these diagrams, the number (N) of fibers A gradually decreases from almost the middle position in the passage, and becomes zero at the nip of the rollers 3 and 3'. Also the number (N) of fibers C is negligibly small at almost the middle position in the passage and gradually increases and becomes maximum at the nip of the rollers 3 and 3!. On the other hand, the number (N) of filaments B is almost constant. However, it must be realized that, even though the continuous filaments B are observed when the stretch break mechanism is stopped, these filaments are surely stretch broken until the rear portion thereof in the stretch break zone is carried to the nip of the rollers 3 and 3'. When the stretch break operation is observed, it can be realized that the fibers A are displaced with the filaments B in an interfering or entangled condition in the stretch break zone. Consequently, it can be assumed that the fibers A interfere with the longitudinal deformation of the filaments B. In other words, if a tension T is considered to be a tension applied to the entire bundle of fibers A with the filament B, component tensions applied to every individual fiber A or filament B varies in accordance with positions along the passage thereof. For example, at the adjacent position to the nip of rollers 2, 2', as it can be understood that the tension T is applied to every fiber A and filament B, the average value of the component tensions applied to each filament B is minimum. However, as the number (N) of fibers A gradually decreases from almost the middle position of the passage, the average value of the component tensions applied to each filament B is consequently increased and becomes maximum at the nip of the rollers 3 and 3'. Therefore, it may be assumed that the above-mentioned phenomena becomes remarkable if the above-mentioned intereference of the fibers A to the filaments B is so strong. The curves D, E, F shown in FIG. 1C represent how the average value of the component tensions applied to the filaments B vary if the average value is assumed at positions along the passage of the filaments B. In these diagrams, the curve D represents a case where the above-mentioned intereference is distinguished, while the curve F represents a case where the above-mentioned interference is not so strong. Consequently, if the stretch break operation is carried out under the interference of the fiber A, in a condition between the above-mentioned two conditions, the curve showing the variation of component tension along the filament passage can be represented by the curve E.

The lengthwise distribution of weak points of the filament will now be considered.

Figure 1D:
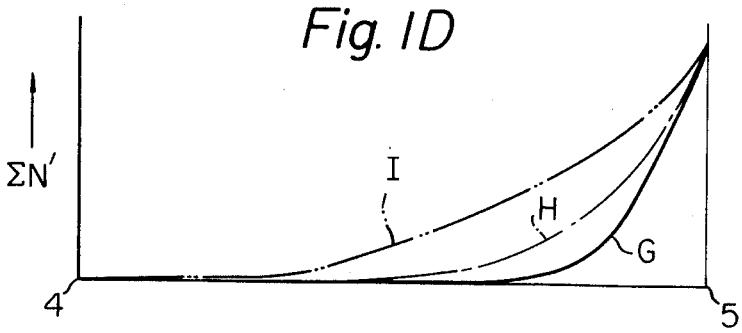

In order to represent the above-mentioned lengthwise distribution of weak points, so-called lengthwise variation of breaking strength of the filament is taking into account. For the convenience of explanation, the term "lengthwise variation of breaking strength" is hereinafter represented as SV. If SV is large, it can be understood that there are very weak points. Consequently, if SV is high, the filaments will possibly break at positions where the average tension applied to the filaments is not so high. In other words, the filaments will possibly break at positions far from the nip of the rollers 3 and 3'. On the other hand, if SV is low, the filaments will most possibly break at positions where the average tension applied to the filament is high. In other words, the filaments will possibly break at positions closer to the nip of the rollers 3 and 3'. If the filaments are stretch broken in the interfering condition represented by the curve F, the filaments will most possibly be broken down in the regions adjacent to the nip of rollers 3 and 3'. And, if the filaments are stretch broken in the condition represented by the curve F the breaking positions of the filaments are dispersed in the rear half passage between the rollers 2, 2' and the rollers 3, 3'. The diagram shown in FIG. 1D represents the possible position, where the filaments are broken down. In this diagram, the ordinate represents the accumulative frequency of the number of broken filaments, while the abscissa represents the position along the fiber passage in the stretch break zone.

Consequently, the curve G corresponds to the condition represented by the curve D in FIG. 1C. The curves H and I correspond to the conditions represented by the curves E and F in FIG. 1C, respectively.

According to the above-mentioned analysis, it was found that, if the interference of the fibers A upon the filaments B becomes larger, the concentration of the stretch break position in a part of the filaments's passage adjacent to the delivery rollers 3, 3' becomes remarkable. This concentration of the stretch break position creates the troubles which are discussed in the introductory part of this specification.

On the other hand, if the lengthwise variation of the breaking strength becomes larger, the position where the filament is stretch broken is spread out in a wider zone along the filament's passage.

It may be understood that the above-mentioned condition D shown in FIG. 1C, that is, the condition I in FIG. 1D, is preferable to eliminate the troubles set forth in the introductory part of this specification. However, when we produce the spinning material, we must consider the quality of the final product. In this sense, it is our opinion that the pertinent condition should be found in a restricted condition which assures not only a trouble free stretch break operation, but also a spinning operation with high efficiency and superior quality of yarn.

In the conventional stretch break operation, the above-mentioned troubles, caused by the concentration of the stretch break positions in a very restricted zone, were analyzed in a different way. It was realized that the interference of the fibers A to the longitudinal deformation of the filaments B was one of the main causes of creating the concentration of the stretch break positions in a very restricted zone. In order to eliminate this trouble, the following two solutions have been generally applied. That is, a suitable oiling is applied to the tow to decrease the friction between the individual filament, and/or the parellelism of filaments of the tow is improved. However, even though the above-mentioned solutions were applied, it was our experience that the above-mentioned trouble, based upon the concentration of the stretch break position, can not be satisfactorily eliminated. This is because it is very difficult to find a preferably oiling condition, and the perfect parallelism of filaments of the tow can not be attained due to the packaging of the tow. It is important to realize the fact that, in the present invention, we found another factor in the creation of the concentration of the stretch break positions of the filaments beside the above-mentioned previously known reasons. That is, we found that the lengthwise variation of the breaking strength of the filaments is another factor in the creation of the concentration of the stretch break positions. Consequently, it is the basic technical idea of this invention to create a tow which satisfies the above-mentioned three factors in combination. Accordingly, in the method and apparatus for manufacturing the above-mentioned tow, the most important point is to provide a preferable condition of SV upon the individual filaments in the tow.

A novel method for producing a tow, which fits the above-mentioned basic idea, was developed, after repeated experimental test. In this method, a certain periodical loading action is applied to a bundle of filaments, which are spinning from spinnerets, just before or after a particular position along a passage thereof, where so-called coagulation of the filaments is completed. This periodical loading action is created by applying periodical deviation of the passage from the normal position thereof. This periodical deviation of the bundle passage can be created by contacting the bundle of filaments upon a polygonal bar which is rotatably mounted on an axis transversally disposed across the filament's passage.

The following apparatus, according to the present invention, is satisfactorily utilized to produce the above-mentioned synthetic tow. Referring to FIGS. 2 and 3*a*, a plurality of filaments are continuously spinning from a pair of spinnerets 5 and 5', into a spinning bath 6, which contains spinning liquid. These filaments are designated as the reference numerals 7, 7'. The filaments are gathered into a bundle of filaments 9 by means of a guide 8. The bundle of filaments 9 is carried to a pair of transfer rollers 15, 16, via a pair of guide rollers 10 and 14, and taken out by a take-up device (not shown).

The coagulation of the filaments 7, 7' proceeds mainly in the bath 6, and is completed at a middle position of the bundle passage between the guide rollers 10 and 14. A polygonal bar 11, is rotatably mounted on an axis 12, which is transversally disposed just before or after a particular position on the bundle passage between the guide rollers 10 and 14, where the coagulation of the filaments is completed. Therefore, when the bundle 9 of filaments is carried along the passage between the guide rollers 10 and 14, the bundle 9 contacts the polygonal bar 11, so that the bar 11 is rotated about the axis 12. The above-mentioned rotation of the bar 11 provides a periodical deviation of the bundle passage by periodically changing the contacting point therebetween from the normal passage to a transversal downward position so that periodical variation is created in the spinning tension. This periodical variation of spinning tension affects the orientation of the molecular construction of the filament. On the other hand, the above-mentioned periodical variation of the bundle passage affects the coagulation speed in the bath 6 because the take-up speed from the spinnerets 5, 5' is effected. As the bundle 9 of filaments has a certain thickness, the above-mentioned influence by the polygonal bar 11 is varied in accordance with the transversal locations of individual filaments in the bundle 9. For example, the individual filament located in the uppermost side of the bundle 9 receives stronger influence than the individual filament located at the lowermost side of the bundle 9. As the polygonal bar 11 is rotated by frictional contact with the bundle 9 of the filaments, a certain slip between the filaments and the transversal edges of the polygonal member 11 can not be prevented. However, it is our understanding that this slip is rather preferable to create the random effect of the above-mentioned phenomena upon the filaments. According to our experimental test, it was confirmed that random lengthwise variation of the breaking strength is observed in the individual filaments produced by the apparatus shown in FIG. 2. Therefore, the above-mentioned polygonal bar should be recognized as a positive member for creating the random distribution of lengthwise variation of breaking strength in the individual filaments. Further, it is important to choose the disposition of the transversal axis 12 on the bundle passage between the guide rollers 10 and 14. As already set forth, the deviation of the bundle passage is very effective in changing the coagulation condition and orientation of the molecular construction of filament if the take-up speed or spinning tension of the filaments is varied in the spinning bath 6. For to this reason, the disposition of the transversal axis 12 is restricted at a particular position which is just before or after a position where the coagulation of the filaments is completed. With respect to the extent of the above-mentioned deviation, it is our common sense that any deviation of the bundle passage, which creates unallowable variation of filament's thickness, must be avoided. This is true even though any preferable effect in connection with the above-mentioned characteristic feature of the tow can be expected. In the present invention, the preferable condition of the passage deviation was found by our experimental tests hereinafter explained in detail. The bundle 9 of filaments produced by the above-mentioned apparatus is then carried to the subsequent drawing, drying and heat-treatment processes. A plurality of bundles 9 are combined in a form of a tow, the tow is provided with suitable crimps and the tow for stretch break operation in a commercial package is finally produced. In the above-mentioned embodiment, the apparatus applied for producing the bundle of filament is the so-called wet system. However, the positive utilization of the polygonal bar can be effectively applied for producing the bundle of synthetic filaments by the so-called dry system or melt spinning system.

With respect to the polygonal bar, more detailed illustration is hereinafter provided. Referring to FIG. 3A showing a perspective view of the polygonal bar 11. An edge 13*a* is formed at each boundary between adjacent two planes of the polygonal member 11*a* in a parallel condition to the transversal axis 12. The number of the edges 13 may be 5 – 8, and the distance between adjacent two edges 13a is preferably chosen in a range between 10 and 30 mm. A modified embodiment of the polygonal bar 11*a* is shown in FIG. 3B, where a side view thereof is shown. In this embodiment, the intervening surface between two adjacent edges 13*b* is a concave surface. However, as the deviation of the bundle passage is created by the contact of the edge 13*b* with the bundle of filaments 9, a similar effect to the first embodiment shown in FIG. 3A can be attained.

As mentioned above, several types of bar can be utilized for the present invention so as to create the deviation of the bundle passage. These bars are generally hereinafter referred to as a deviation bar.

Any material, such as stainless-steel or chrome-plated steel, having sufficient resistance to corrosion by chemical agents can be used for the deviation bar. However, in case of the melt spinning, where the spinning speed is fairly high, the rotation of the deviation bar must follow the spinning speed. Consequently, a light metal or its alloy, such as aluminum, is preferably used for the deviation bar.

In the above-mentioned illustration, the deviation bar is made to rotate by frictional contact with the running bundle 9 of filaments. However, to create the deviation of the bundle passage, the deviation bar can be positively driven separately from the running of the bundle 9 of the filaments. In this case, if the deviation bar is turned in a varied condition, a similar result to the above-mentioned embodiment can be attained without relation to the shape of the deviation bar.

In order to find the pertinent physical condition of the tow, the experimental tests described below were carried out. In the tests, several types of deviation bars were utilized. The tests were applied for manufacturing the tows by means of the wet system, dry system and melt spinning system. In every experimental test, the lengthwise variation of the breaking strength of individual filaments was measured as a main measure of the physical properties which relate to the operational condition of the draft cut operation. Further, the spinning condition, physical properties of the yarn, etc., were observed or measured. Before explaining the experimental tests, the meanings or definitions of several terms are illustrated.

Average lengthwise variation of the breaking strength of individual filaments:

150 test pieces are sequentially taken from each individual filament in a tow with 4 cm intervals. The breaking strength is measured by a conventional tester produced by SHIMAZU SEISAKUSHO, Japan (Trade mark: SHIMAZU AUTOGRAPH), under the following condition: test gauge 3 cm, loading speed (or extension speed) 100%/min. Then the lengthwise variation of the breaking strength of the individual filament (SV) is calculated. After completion of the above-mentioned tensil tests, applied to 50 individual filaments taken from the tow, the average value of SV is calculated. This calculated value represents the average lengthwise variation of the breaking strength (hereinafter represented as SV).

Coefficient of autocorrelation in connection with lengthwise variation of breaking strength of individual filaments:

If the weak points are located in a very restricted portion of each individual filaments, or tow, the filaments have strong possibility to break at the above-mentioned portion in the stretch break operation. In this case the troubles set forth in the introductory part of this specification occur many times. This concentration of the weak point should be eliminated in the tow for the stretch break process. In other words, it is desirable to spread out the weak point randomly along each endless filament. This randomness can be represented by the term "lengthwise unevenness". In order to calculate the lengthwise unevenness, the coefficient of autocorrelation is calculated, and the correlogram made by the well known method of statistical mathematics. In this mathematical analysis, as the length of the test piece is 4 cm and the test pieces are sequentially taken from each individual filament, $\Delta l = 4$ cm. It is the common sense, that, if the coefficient of autocorrelation R is less than 0.2, the variation of the measure (in the present case, the lengthwise variation of the breaking strength) can be interpreted as "random". Further, according to the practical meaning, that is, the distance between the nip of rollers 2, 2' and the nip of rollers 3, 3', if the random distribution of the weak point is ascertained in a length between 4 cm and 60 cm, in other words between K = 1 and K = 15, where K represents the unit of the ordinate of the correlogram, this filament satisfies the random distribution of the weak points therein in the practical sense. The coefficient of autocorrelation is designated as $R(K\Delta l)$ and represented by the following equation.

$$R_j(K\Delta l) = \frac{1}{n-K} \sum_{i=1}^{n} F_j(i\Delta l) F_j[(i+K)\Delta l]$$

where $F_j(i\Delta l) = f_j(i\Delta l) - \overline{f_j}$.

j represents individual filaments taken from the tow, that is, $j = 1 - 50$.

$n$ represents total number of the test pieces, that is $n = 150$.

$i$ represents sequential number of the test piece that is $i = 1 - 150$.

$f_j(i\Delta l)$ represents a breaking strength of a test piece of $i^{th}$ sequential number, which corresponds to a point designated by 17 in FIG. 4.

$\overline{f_j}$ represents an average of $f_j$, which corresponds to a horizontal line 18 in FIG. 4, that is, $$\overline{f_j} = \frac{1}{n} \sum_{i=1}^{n} f_j(i\Delta l)$$

Lengthwise unevenness of the breaking strength:

If the weak points are located randomly in each individual filament, it is important to next restrict the lengthwise unevenness of the breaking strength in connection with each individual filament in the tow. This lengthwise unevenness of the breaking strength (hereinafter abbreviated to as LUBS) is calculated by the following equation.

$$\text{LUBS} = \frac{(\text{Standard deviation of } \overline{f_i})}{(\text{Average of } f_i)} \times 100\ (\%)$$

$$\text{where } \overline{f_i} = \frac{1}{m} \sum_{j=1}^{m} f_j(i\Delta l)$$

$$m = 1 - 50$$

It was realized that the unevenness of breaking strength between individual filament should be restricted to attain the purpose of the present invention. This unevenness is hereinafter referred to as "transversal unevenness of breaking strength between individual filaments in a tow" (hereinafter abbreviated to as TUBS). Tubs is calculated by the following equation;

$$\text{TUBS} = \frac{(\text{Standard deviation of } \bar{f}_j)}{(\text{Average of } f_j)} \times 100\ (\%)$$

Coefficient of static friction and that of dynamic friction:

As already discussed in the introductory part of this specification, the friction between individual filaments in a tow effects the intereference between the stretch break fiber A with the filaments B. Consequently, it is also important to find a desirable condition of the oiling. For this purpose, the coefficient of static friction and that of dynamic friction were measured by the so-called "Roder method", which was illustrated in detail in the "Journal of the Textile Institute" T 247, June, 1953.

EXPERIMENTAL TEST NO. 1

In the process for manufacturing an acrylic tow of 480,000 denier consisting of 3 denier individual filaments from a copolymer composed of 96% acrylicnitrile and 4% acetic acid vinyl, the apparatus shown in FIG. 2 is utilized. In this apparatus, the deviation device 11*a* is provided with spiral edges instead of the edges 13*a* formed in parallel to the transversal axis 12. Each spiral edge has a spiral angle of 10° to the axis 12. 25% dimethylformamide solution (DMF) of the above-mentioned copolymer is used as a spinning solution. The spinning temperature is 80° C and the coagulation liquid is a liquid composed of water containing a little DMF and is maintained at 45° C. A group of filaments (total number $4 \times 10^4$) (hereinafter referred to as a primary tow) were spun from the spinnerets and taken up from the spinning bath 6, at a take up speed of 40 m/min, and led to the transfer rollers 15, 16 while contacting the deviation bar 11. They were then stretched 5 times in a hot water bath maintained at about 95° C. After an oiling treatment, the primary tow was dried at 130° C. After the drying operation, four primary tows produced by the above-mentioned processes are bundled together and after providing crimps, a secondary tow is produced. This secondary tow is treated by heat by saturated steam (2.0 kg/cm² pressure), and a commercial tow having a uniform thickness with 170 mm width is finally produced. In the above-mentioned experimental tests, four deviation bars having different sizes and shapes were used.

The characteristics of the tows were compared with the tow produced by the normal apparatus without the deviation bar. Table 1 shows the data of this test.

Table 1

| Identification | 1 | 2 | 3 | 4 | 5 |
|---|---|---|---|---|---|
| Condition | Normal apparatus | Apparatus shown in Fig. 2 | | | |
| Shape of the deviation bar | | regular heptagon | regular hexangle | regular pentagon | square |
| Intervening distance between two adjacent edges (cm) | | 1.5 | 1.5 | 1.5 | 2.0 |
| Period of deviation of the bundle passage (Hz) | | 44.4 | 44.4 | 44.4 | 33.3 |
| Magnitude of the deviation of the bundle passage (mm) | | 1.7 | 2.0 | 2.4 | 5.9 |
| Average breaking strength of individual filaments (gr) | 8.5 | 8.7 | 8.6 | 8.4 | 8.3 |
| Average lengthwise deviation of the breaking strength (%) | 6.2 | 8.1 | 13.4 | 18.0 | 23.5 |
| TUBS | < 10% | < 10% | < 10% | < 10% | 13% |
| LUBS | < 9% | < 9% | < 9% | < 9% | 11% |
| Coefficient of static friction | 0.25 ~ 0.30 | 0.25 ~ 0.30 | 0.25 ~ 0.30 | 0.25 ~ 0.30 | 0.25 ~ 0.30 |
| Coefficient of dynamic friction | 0.23 ~ 0.27 | 0.23 ~ 0.27 | 0.23 ~ 0.27 | 0.23 ~ 0.27 | 0.23 ~ 0.27 |

According to statistical analysis by correlogram, it was observed that the tow produced by the condition identified by No. 5 has a so-called periodical variation of the breaking strength along the filament axis.

Next, the above-mentioned tows were subjected to the stretch break process under the conditions shown in Table 2.

Table 2

| | | |
|---|---|---|
| Primary stretch | | 1.2 times |
| Temperature of the primary stretching | | 160° C |
| First stretch break operation | Gauge | 450 mm |
| | Draft | 4.0 |
| Second stretch break operation | Gauge | 180 mm |
| | Draft | 1.5 |
| Delivery speed | | 60 m/min |

In the above-mentioned stretch break operation, the operative condition was carefully observed. Table 3 shows the result obtained by this observation.

Table 3

| Test No. | Operative condition observed | Average staple length after the first stretch break operation | Load consumed to carry out the operation |
|---|---|---|---|
| | In the first stretch break operation, | | |

Table 3-continued

| Test No. | Operative condition observed | Average staple length after the first stretch break operation | Load consumed to carry out the operation |
|---|---|---|---|
| 1 | breaking points of individual filaments are frequently concentrated in the adjacent position to the delivery rollers, and wrapping of fibers about the delivery rollers frequently happens | 110 mm | 85 kg |
| 2 | Almost no trouble | 150 mm | 74 kg |
| 3 | Good condition | 193 mm | 66 kg |
| 4 | Good condition | 210 mm | 61 kg |
| 5 | Almost no trouble, however, in the first stretch break operation, the breaking points of individual filaments was often concentrated in the adjacent position to the delivery rollers | 205 mm | 54 kg |

As can be clearly understood from Table 3, the tows identified as Nos. 2, 3 and 4 are superior property to fit the stretch break operation. After producing slivers from the tows, a yarn ($36^s$ metric system count) was produced from each tow. Table 4 shows several physical properties of these yarns.

Table 4

| Test No. | Breaking strength of single yarn (gr) | Variation of breaking strength (%) | Variation of shrinkage created by treating in boiling water (%) |
|---|---|---|---|
| 1 | 380 | 19 | 2.5 |
| 2 | 395 | 10 | 1.0 |
| 3 | 332 | 11 | 0.5 |
| 4 | 406 | 11 | 0.3 |
| 5 | 303 | 18 | 3.0 |

As it can be understood from Table 4, the yarn produced from the tows identified by Nos. 2, 3 and 4 have superior properties. In the spinning operation, the number of yarn breakages was observed. According to this observation, the number of yarn breakage for 400 spindles/hour was 5 – 6 ends in case of tows Nos. 2, 3 and 4, while 8 ends and 15 ends in cases of the tows No. 1 and No. 5, respectively.

As an additional experimental test, duplicate tows were supplied to the OM Tow-Reactor and a similar test was carried out. Test result similar to those of the above-mentioned test were confirmed.

EXPERIMENTAL TEST No. 2

In the process for manufacturing a polypropylene filament tow of 2,400 denier consisting of 3 denier individual filaments from a polymer produced by Mitsubishi Yuka Co., Ltd. (identification No. 2,000), the deviation bar shown in FIG. 3B was utilized. The spinning operation was carried out at 250° C, at a take-up speed of 600 m/min.. The above-mentioned primary tow was positively contacted with the deviation device in the deviation passage. Thereafter, 200 primary tows were bundled to form a secondary tow, and the secondary tow was subjected to the stretching operation. This stretching operation was carried out at 130° C, and the tow was stretched 5 times. Then the stretched tow was provided with suitable crimps and oilings and a commercial tow having 180 mm width was produced. In the above-mentioned experimental test, three deviation bars having different shapes were used and similar tests to the first experimental test were applied. Table 5 shows the data of this test. Next, the above-mentioned tow were subjected to the stretch break process under the following condition: the draft and gauge of the first stretch break operation were 4.0 and 800 mm respectively, the delivery speed of this first stretch break operation was 30 m/min. In the above-mentioned stretch break operation, the operative condition was carefully observed. Table 6 shows the result obtained by this observation.

Table 5

| Identification | 6 | 7 | 8 | 9 |
|---|---|---|---|---|
| Condition | Normal apparatus | Apparatus shown in FIG. 2. The deviation bar shown in FIG. 3C. | | |
| Shape of the deviation bar (number of blades) | | 7 | 6 | 4 |
| Intervening distance between edges of two adjacent blades (cm) | | 2.0 | 2.0 | 2.0 |
| Period of deviation of the bundle passage (Hz) | | 500 | 500 | 500 |
| Magnitude of the deviation of the bundle passage (mm) | | 2.2 | 2.7 | 5.9 |
| Average breaking strength of the individual filaments (gr) | 18 | 20 | 19 | 12 |
| Average lengthwise deviation of the breaking strength (%) | 7.7 | 10.6 | 15.8 | 21.3 |
| TUBS | < 10% | < 10% | < 10% | 11% |
| LUBS | < 9% | < 9% | < 9% | 9% |
| Coefficient of static friction | 0.28~ 0.32 | 0.28 ~ 0.32 | 0.28 ~ 0.32 | 0.28 ~ 0.32 |
| Coefficient of dynamics friction | 0.26 ~ 0.29 | 0.26 ~ 0.29 | 0.26 ~ 0.29 | 0.26 ~ 0.29 |

Table 6

| Test No. | Operative condition observed | Average staple length after the first stretch break operation | Load consumed to carry out the operation |
|---|---|---|---|
| 6 | In the first draft cut operation, breaking points of individual filaments are frequently concentrated in the adjacent position to the delivery rollers. | 165 mm | 120 kg |
| 7 | Good condition | 240 mm | 101 kg |
| 8 | Good condition | 315 mm | 99 kg |
| 9 | In the first stretch break operation, the breaking points of individual filaments are often concentrated in the adjacent position to the delivery rollers | 340 mm | 84 kg |

As it can be clearly understood from Table 6, the tows identified as Nos. 7 and 8 are superior to property to fit the stretch break operation.

SUMMARY OF THE EXPERIMENTAL TESTS

According to the above-mentioned experimental tests, we found that the following conditions have to be satisfied to: operate the stretch break operation of synthetic tows in a desirable condition, without any trouble such as wrapping fibers about the delivery rollers; to spin yarn without many yarn breakages during the spinning operation, and; to produce yarns of superior quality.

1. The excess interference between the stretch broken fibers and the filaments should be avoided.

2. The stretch break points should be concentrated in a position adjacent to the delivery rollers.

3. The wrapping of the stretch broken fibers about the delivery rollers should be eliminated.

In order to satisfy the above-mentioned conditions, the weak points of the filaments should be lengthwisely spread out along the filament in random condition. However, according to the experimental tests, it was confirmed that the above-mentioned requirements can be satisfied if: the average lengthwise variation of the breaking strength of individual filaments is in a range of 8 – 20%; the lengthwise unevenness of the breaking strength is below 9%; the transversal unevenness of the breaking strength is below 10%, and; the coefficients of static friction and dynamic friction are in the ranges between 0.20 – 0.35 and 0.18 – 0.30, respectively. Further, with respect to the deviation of the bundle passage during the continuous taking out of the bundle of filaments from the respective spinnerets, the most pertinent condition was found.

According to our experience, if the stretch break operation is carried out under poor conditions, which as already discussed is mainly caused by the orientation of the molecular structure in the filaments, the fabric produced by the yarn produced therefrom may have possible defects for dyeing or finishing. Therefore, we believe that the present invention makes a large contribution to the improvement of the quality of textile fabric utilizing a yarn applied to the stretch break process.

It can be understood that, even though the above-mentioned experimental tests were applied for the acrylic filament tow, polypropylene filament tow and the polyester filament tow, the basic principle, method and apparatus can be applied to other types of synthetic filament tow.

We claim:

1. An apparatus for continuously producing a synthetic filament's tow from a plurality of synthetic filaments comprising a pair of guide rollers for leading said filaments from spinnerets to a transfer roller for guiding said filaments to a take-up means, a guide disposed at a position where coagulation of said filaments has not been completed, deviation bar means provided with a plurality of transverse radially projecting edges for periodically deviating passage of said tow during rotation of said bar means from a passage defined only by said guide rollers by means of rotational contact of each of said edges with said tow, said bar means being rotatably mounted on an axis transversal to said filaments and disposed just before or after a particular position on a passage defined by said pair of guide rollers were coagulation of said filaments are completed.

2. In an apparatus for producing a synthetic filament's tow according to claim 1, wherein said deviation bar derives its rotational force from frictional contact of said edges with said tow.

3. In an apparatus for producing a synthetic filament's tow according to claim 1, wherein said deviation bar is connected with an external means for positively driving the bar.

4. In an apparatus for producing a synthetic filament's tow according to claim 1, wherein said deviation bar has a regular polygonal cross-section when said bar is cut across said transversal axis.

5. In an apparatus for producing a synthetic filament's tow according to claim 1, wherein said edges of said deviation bar are arranged with an intervening space between two adjacent edges thereof in a range 10 – 30 mm.

6. In an apparatus for producing a synethtic filament's tow according to claim 1, wherein each of said edges of said deviation bar are arranged in parallel condition to said transversal axis.

* * * * *